US006283022B1

(12) United States Patent
Kamen et al.

(10) Patent No.: US 6,283,022 B1
(45) **Date of Patent: *Sep. 4, 2001**

(54) APPARATUS AND METHOD FOR DIRECT ROTARY SCREEN PRINTING RADIATION CURABLE COMPOSITIONS ONTO CYLINDRICAL ARTICLES

(75) Inventors: Melvin E. Kamen, Highlands; Marvin Wells, East Windsor, both of NJ (US)

(73) Assignee: Deco Patents, Inc., Edison, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,811

(22) Filed: Oct. 6, 1998

Related U.S. Application Data

(60) Provisional application No. 60/062,834, filed on Oct. 17, 1997.

(51) Int. Cl.[7] ..... B41F 15/12; B41F 15/30

(52) U.S. Cl. ..... 101/129; 101/120; 101/122; 101/40; 101/35

(58) Field of Search ..... 101/35, 38.1, 39, 101/40, 40.1, 116, 118, 119, 120, 123, 129, 121, 122, 36, 37, 250, 251

(56) References Cited

U.S. PATENT DOCUMENTS

| | | | | |
|---|---|---|---|---|
| 1,066,488 | | 7/1913 | Ginaca | 101/40 |
| 2,134,041 | * | 10/1938 | Hamm | 101/35 |
| 2,160,725 | * | 5/1939 | Flint | 101/39 |
| 2,327,668 | * | 8/1943 | Rempel | 101/40 |
| 2,881,699 | | 4/1959 | Hakogi | 101/126 |
| 3,139,817 | | 7/1964 | Terry, Jr. | 101/37 |
| 3,518,938 | | 7/1970 | Donner et al. | 101/40 |
| 3,543,680 | | 12/1970 | Killen et al. | 101/40 |
| 3,564,998 | | 2/1971 | Johnson et al. | 101/40 |
| 3,783,777 | | 1/1974 | Killen et al. | 101/40 |
| 3,816,207 | | 6/1974 | Robertson et al. | 101/7 |
| 3,933,091 | | 1/1976 | Von Saspe | 101/40 |
| 4,005,649 | | 2/1977 | Strauch et al. | 101/40 |

(List continued on next page.)

FOREIGN PATENT DOCUMENTS 0 677 364 B1 10/1995 (EP) .

OTHER PUBLICATIONS

Advertising Material from Otto Isenschmid Corp., Beltograph Screen–Belt Printing Press, undated.

Advertising Material from Gallus, Rota–Screen System, undated.

Advertising Material from Krones, Inc., Thermocol Heat Transfer Container Decorating, undated.

Advertising Material from Stork X–cel Inc., Rotary Screen Converting System (RSC), undated.

Advertising Material from Stork X–cel Inc., Rotary Screen Printing Technology with RotaMesh, undated.

Advertising Material from Stork X–cel Inc., Rotary Screen Integration Program, undated.

*Primary Examiner*—John S. Hilten
*Assistant Examiner*—Leslie J. Grohusky
(74) *Attorney, Agent, or Firm*—Lerner, David, Littenberg, Krumholz & Mentlik, LLP

(57) ABSTRACT

An apparatus and method for decorating cylindrical articles using direct rotary screen printing of a UV radiation curable composition in various predetermined patterns and registrations. A rotary screen printing assembly is arranged in either a horizontal or vertical orientation to achieve production rates of about at least 250 articles per minute, and up to 1000 articles per minute. The UV radiation curable compositions are at least partially cured between a plurality of screen printing workstations using a UV radiation source.

55 Claims, 6 Drawing Sheets

U.S. PATENT DOCUMENTS

| | | | | |
|---|---|---|---|---|
| 4,026,208 | * | 5/1977 | Horne, Jr. et al. | 101/127.1 |
| 4,068,579 | | 1/1978 | Poo et al. | 101/124 |
| 4,091,726 | | 5/1978 | Walker | 101/126 |
| 4,176,598 | | 12/1979 | Dubuit | 101/40.1 |
| 4,263,846 | | 4/1981 | Eldred et al. | 101/40 |
| 4,282,806 | | 8/1981 | Lala | 101/41 |
| 4,352,326 | | 10/1982 | Kammann | 101/123 |
| 4,380,955 | | 4/1983 | Okura | 101/115 |
| 4,434,714 | | 3/1984 | Combeau | 101/126 |
| 4,440,589 | | 4/1984 | Lock | 101/34 |
| 4,480,540 | | 11/1984 | Lock et al. | 101/36 |
| 4,519,310 | | 5/1985 | Shimizu et al. | 101/35 |
| 4,628,857 | | 12/1986 | Coningsby | 118/406 |
| 4,729,305 | * | 3/1988 | Spencer | 101/122 |
| 4,798,135 | | 1/1989 | Meredith | 101/40 |
| 4,885,992 | | 12/1989 | Duce | 101/38.1 |
| 5,207,156 | | 5/1993 | Helling | 101/38.1 |
| 5,247,882 | | 9/1993 | Zook et al. | 101/120 |
| 5,317,967 | | 6/1994 | Heideneich | 101/38.1 |
| 5,357,856 | | 10/1994 | Hasegawa et al. | 101/120 |
| 5,372,064 | | 12/1994 | Dubuit et al. | 101/40 |
| 5,434,804 | | 7/1995 | Bock et al. | 364/579 |
| 5,471,924 | | 12/1995 | Helling | 101/38.1 |
| 5,477,781 | | 12/1995 | Stefani | 101/153 |
| 5,487,927 | | 1/1996 | Kamen et al. | 128/34.4 |
| 5,524,535 | | 6/1996 | Strutz et al. | 101/38.1 |
| 5,571,359 | | 11/1996 | Kamen et al. | 156/233 |
| 5,656,336 | | 8/1997 | Kamen et al. | 427/511 |
| 5,953,988 | * | 9/1999 | Vinck | 101/129 |

* cited by examiner

APPARATUS AND METHOD FOR DIRECT ROTARY SCREEN PRINTING RADIATION CURABLE COMPOSITIONS ONTO CYLINDRICAL ARTICLES

This application claims the benefit of Provisional Application No. 60/062,834 filed on Oct. 17, 1997.

FIELD OF THE INVENTION

The present invention relates in general to decorating technology applicable to cylindrical articles using direct rotary screen printing of radiation curable compositions in various predetermined patterns and registrations. Still more particularly, the present invention is directed to an apparatus and method for decorative direct rotary screen printing of various cylindrical articles such as glassware and the like with ultraviolet radiation (UV) curable compositions and the like.

BACKGROUND OF THE INVENTION

In the glassware decorating industry, there exists the desire to apply one or more layers of a suitable material in various predetermined patterns to an article for decorative or other purposes. One of the important commercial applications today is in the printing of bottles having a generally cylindrical configuration. The term "cylindrical" as used herein is intended to cover articles, e.g., bottles, which have at least one portion which is characterized by a cylindrical cross-sectional shape, e.g., substantially circular or round. The aforementioned bottles have found a wide variety of applications, for example, cosmetics, perfumes, food products, household and personal cleansing products, etc. One application which is believed to dominate the present market in terms of volume is beverage bottles for both soft and alcoholic beverages.

There is known a variety of apparatuses for decorating bottles with multiple colored printing inks for forming decorative predetermined patterns and/or textured material. For example, it has been common practice to decorate cylindrical shaped bottles using a screen printing apparatus which includes a conventional reciprocating screen printing assembly. In the known reciprocating screen printing assembly, a generally rectangular frame supports a patterned screen which carries the printing ink to be screen printed onto the underlying article by means of a squeegee. In one such type of screen printing assembly, the screen is held stationary while the squeegee is moved across the surface of the screen in order to force the printing ink through the screen thereby creating the desired pattern. In another screen printing assembly, the screen is reciprocated laterally while maintaining the squeegee stationary in engagement with the surface of the screen. Illustrative of the aforementioned screen printing assembly are those disclosed in Poo, et al., U.S. Pat. Nos. 4,068,579; Walker, 4,091,726; Eldred, et al., 4,263,846; Lala, 4,282,806; Cammann, 4,352,326; Okura, 4,380,955; Combeau, 4,434,714; Heidenreich, 5,317,967; Carlyn, et al., 5,343,804; and Strutz, et al., U.S. Pat. No. 5,524,535 the disclosures of which are incorporated herein by reference.

In addition to the aforementioned reciprocating screen printing assemblies, there is known from Von Saspe, U.S. Pat. No. 3,933,091 a screen printing apparatus employing a stationary semi-circular printing screen using a rotatable squeegee assembly having a plurality of squeegees. There is further known from Coningsby, U.S. Pat. No. 4,628,857, a screen printing apparatus including a horizontally arranged rotary screen printing assembly. The screen printing assembly is operative for printing a non-continuous coating on a substrate of various shapes such as cylindrical, conical or oval, in particular, slender-like articles such as writing implements. The screen printing assembly is in the nature of a cylindrical hollow printing drum provided with an opening for accommodating a patterned screen. The interior of the drum includes a squeegee and a supply of printing ink. Articles to be screen printed are placed on a conveyor and moved to a position underlying the screen at which time the article is lifted by an elevator mechanism into engagement with the continuously rotating screen printing drum. The disclosures in U.S. Pat. Nos. 3,933,091 and 4,628,857 are incorporated herein by reference.

In Duce, U.S. Pat. No. 4,885,992 there is disclosed a vertically arranged indirect rotary screen printing assembly particularly adapted for printing spark plug insulators, the disclosure of which is incorporated herein by reference. The screen printing assembly includes a vertically arranged screen printing drum provided with a printing screen and an internal squeegee. The screen is arranged in contact with a transfer roller having a transfer surface. The image to be transferred is first applied to the transfer surface and, upon rotation of the transfer roller, to the surface of the intended article such as the spark plug insulator. The use of a vertical screen printing assembly avoids having to index articles to be printed from an initial vertical supply orientation to a horizontal printing orientation, and then back again to a vertical discharge orientation.

The economics of the bottle screen printing industry are directly related to production rate. Conventional reciprocating screen printing assemblies are known to achieve production rates of only about 180 bottles per minute. In the lucrative beverage bottle decorating industry, it is desirable to obtain production rates of at least 250 bottles per minute, and preferably 500–700 bottles per minute, and optimally up to 1000 bottles per minute. These production rates cannot be achieved by the aforementioned reciprocating screen printing assemblies. In addition, the conventional reciprocating screen printing assemblies, due to their stroke length, e.g., up to about 36 inches, occupy a substantial space within the screen printing apparatus. As a result, the space provided for curing the screen printed ink is often inadequate, rendering the aforementioned screen printing apparatus generally undesirable for multi-colored screen printing operations where curing is required between screen printing workstations, and in particular, where high production rates are desired. This becomes more significant when screen printing multiple registered layers of a printing ink which requires overprinting of one layer with the next layer without the adverse consequences of streaking of the previously applied layer.

In Von Saspe, production rates of up to 220 bottles per minute are disclosed using the stationary semi-circular screen printing assembly. However, the screen printing apparatus of Von Siaspe requires multiple drying tunnels which occupy a large portion of the screen printing apparatus, and hence, floor space which might not always be available.

A number of the aforementioned disadvantages from the known screen printing apparatus are overcome by the screen printing apparatus disclosed in U.S. patent application Ser. No. 432,485, filed on May 1, 1995, and assigned to the same assignee of the present application the disclosure of which is incorporated herein by reference. The disclosed reciprocating screen printing apparatus arranges a UV radiation source opposing the printing screen at each screen printing workstation. Articles to be decorated are positioned between the UV radiation source and the printing screen. Each article is printed with an image formed from a UV curable composition by being rolled across the printing screen. The UV radiation source is positioned so that as the applied image is transferred to the article, UV radiation is incident upon the article's surface as it rolls away from the printing screen with the newly transferred image. The image is exposed to the UV radiation for a sufficient duration such that a cured skin forms on the surface of the transferred image of sufficient strength to support the next layer to be applied to the article. The disclosed screen printing apparatus has a production rate of up to about 180 bottles per minute.

Notwithstanding the known screen printing apparatus, there remains a need for a screen printing apparatus and decorating method therefore which is operable for printing UV curable compositions in various patterns and/or registered layers directly onto articles having cylindrical portions at a production rate heretofore unknown from the prior art, while at the same time, providing for the at least partial cure of the UV curable composition between one or more screen printing workstations.

SUMMARY OF THE INVENTION

One object of the present invention is to provide an apparatus and method for direct rotary screen printing radiation curable compositions onto cylindrical articles, and particularly, glassware such as bottles and the like.

Another object of the present invention is to provide an apparatus and method for direct rotary screen printing radiation curable compositions onto cylindrical bottles at improved production rates.

Another object of the present invention is to provide an apparatus and method for direct rotary screen printing radiation curable compositions onto cylindrical articles, while providing at least partial cure of the radiation composition between one or more screen printing workstations.

Another object of the present invention is to provide an apparatus and method for direct rotary screen printing radiation curable compositions which minimizes the space occupied by the screen printing assembly.

Another object of the present invention is to provide an apparatus and method for direct rotary screen printing radiation curable compositions which accommodates the screen printing of multiple colors at a plurality of screen printing workstations within a single apparatus.

Another object of the present invention is to provide an apparatus and method for direct rotary screen printing radiation curable compositions which does not require manipulation of the articles from an initially vertical supply orientation to a screen printing horizontal orientation, and then to a vertical discharge orientation.

Another object of the present invention is to provide an apparatus and method for direct rotary screen printing radiation curable compositions by retrofitting existing screen printing apparatuses with rotary screen printing assemblies and radiation emitting devices.

In accordance with one embodiment of the present invention there is described an apparatus for direct rotary screen printing a layer of radiation curable material onto articles having a cylindrical surface, the apparatus comprising a supply of radiation curable material, a rotary screen printing assembly operative for directly screen printing a layer of the radiation curable material onto the cylindrical surface of the articles, and a radiation emitting device adjacent the rotary screen printing assembly operative for at least partially curing the layer of radiation curable material applied to the articles.

In accordance with another embodiment of the present invention there is described an apparatus for direct rotary screen printing a patterned layer of UV radiation curable material onto glass bottles having a cylindrical surface, the apparatus comprising a rotary screen printing assembly having an interior portion at least partially defined by a printing screen, the rotary screen printing assembly operative for direct screen printing the patterned layer of UV radiation curable material onto the cylindrical surface of the glass bottles, a supply of UV radiation curable material provided within the interior portion of the rotary screen printing assembly, means for dispersing the UV radiation curable material over at least a portion of the printing screen for screen printing the patterned layer, a UV radiation emitting device adjacent the rotary screen printing assembly operative for at least partially curing the patterned layer of UV radiation curable material applied to the bottles, and a conveyor extending through the apparatus for transporting the bottles into operative relationship within the rotary screen printing assembly and the UV radiation emitting device.

In accordance with another embodiment of the present invention there is described a process for directly applying a layer of radiation curable material onto articles having a cylindrical surface, the process comprising conveying the articles into operative association with a rotary screen printing assembly, directly screen printing a layer of radiation curable material onto the cylindrical surface of the articles using the rotary screen printing assembly, and exposing the screen printed layer on the articles to radiation sufficient to at least partially cure the screen printed layer.

In accordance with another embodiment of the present invention there is described a process for directly applying a patterned layer of UV radiation curable material onto glass bottles having a cylindrical surface, the process comprising screen printing the patterned layer of UV radiation curable material directly onto the cylindrical surface of the bottles using a rotary screen printing assembly, the rotary screen printing assembly having an interior portion at least partially defined by a printing screen, supplying UV radiation curable material into the interior portion of the rotary screen printing assembly, dispensing the UV radiation curable material over at least a portion of the printing screen for screen printing the patterned layer of UV radiation curable material, exposing the screen printed layer on the bottles to radiation sufficient to at least partially cure the screen printed layer, and conveying the bottles into operative association with the rotary screen printing assembly and the radiation.

In accordance with another embodiment of the present invention there is described an apparatus for direct rotary screen printing a layer of radiation curable material onto articles, the apparatus comprising a supply of radiation curable material, a rotary screen printing assembly operative for directly screen printing a layer of the radiation curable material onto the surface of the articles, means for transporting the articles in operative relationship with the rotary screen printing assembly at a first rate, a radiation emitting device adjacent the rotary screen printing assembly operative for at least partially curing the layer of radiation curable material applied to the articles, and means for transporting the rotary screen printing assembly in operative relationship with the articles at a second rate.

In accordance with another embodiment of the present invention there is described a process for directly applying a layer of radiation curable material onto articles having a surface, the process comprising conveying the articles into operative association with a rotary screen printing assembly, directly screen printing a layer of radiation curable material onto the cylindrical surface of the articles using the rotary screen printing assembly, conveying the rotary screen printing assembly in operative relationship with the articles, and exposing the screen printed layer on the articles to radiation sufficient to at least partially cure the screen printed layer.

BRIEF DESCRIPTION OF THE DRAWINGS

The above description, as well as further objects, features and advantages of the present invention will be more fully understood with reference to the following detailed description of an apparatus and method for direct rotary screen printing radiation curable compositions, when taken in conjunction with the accompanying drawings, wherein.

DETAILED DESCRIPTION OF THE PREFERRED EMBODIMENTS

Figure 1:
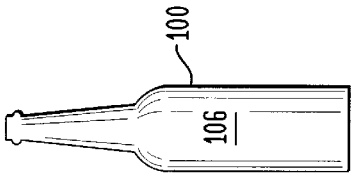
FIGS. 1–3 are front elevational views of various articles in the nature of glassware having cylindrical portions for decorating by screen printing pursuant to the apparatus and method of the present invention.
Figure 2:
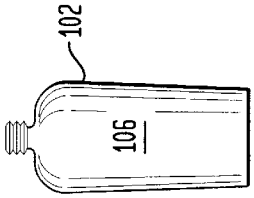
Figure 3:
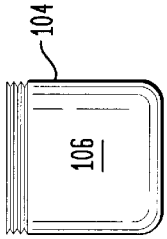

Referring to the drawings, wherein like reference numerals represent like elements, there is shown in FIGS. 1–3 a variety of articles for decorating or otherwise screen printing in accordance with the apparatus and method of the present invention using a UV radiation curable composition. The apparatus and method of the present invention is particularly suitable for the glassware decorating industry where various glass substrates, e.g., glass bottles and the like are decorated with one or multiple registered layers of the UV radiation curable composition. In this regard, the glass substrates to be decorated have a generally cylindrical shape provided with at least one cylindrical portion to receive the screen printing.

In FIG. 1 there is shown a glass beverage bottle 100, in FIG. 2 a glass perfume and/or cosmetic-type bottle 102, and in FIG. 3 a glass wide mouth bottle 104. Each of the bottles 100, 102, 104 are provided with a cylindrical surface 106 to receive various patterns in the nature of graphic designs, textual material, etc. in one or more layers of various colors using UV radiation curable compositions in accordance with the apparatus and method of the present invention. However, the apparatus and method of the present invention is also suitable for substrates other than glass, for example, plastic and ceramic, which may include other types of containers such as cups, dishes, vases and other decorative glassware, and other cylindrical shaped articles to which there is a desire to provide a screen printed layer for decorative or functional purposes.

Examples of UV radiation curable compositions suitable for use in the present invention are described in Kamen, et al., U.S. Pat. Nos. 5,571,359 and 5,487,927 which compositions and applications are incorporated herein by reference. In general, these radiation curable compositions contain a radiation curable component which may be monomers, oligomers, or low molecular weight homopolymers, copolymers, terpolymers, graft copolymers or block copolymers, so long as the component is cured (polymerized) by exposure to electron beam, actinic or ultraviolet radiation. The radiation curable component is capable, after curing, to bind to the substrate to which it is applied to a degree sufficient to be commercially acceptable for decorating purposes. This means that the composition must be permanently affixed to the substrate to a degree sufficient to remain on the substrate for the useful life of the substrate. For example, where the substrate is a container containing nail enamel, the composition must remain on the container throughout the useful life of the nail enamel and remain resistant to the solvents and other ingredients found in nail enamel. In the preferred composition, the radiation curable component is curable by ultraviolet radiation having a wavelength of 4 to 400 nm, and preferably 325 to 365 nm. In the case of actinic radiation, the radiation curable component is curable by actinic radiation having the wavelength of 4–600 nm.

UV radiation curable compositions having high performance adhesion suitable for beverage bottles are known from U.S. Pat. No. 5,656,336, which patent is assigned to the same assignee of the present application. Also, UV radiation curable compositions for beverage bottles which are formulated to be removed upon exposure to an alkali solution are known from U.S. patent application Ser. No. 868,409, filed on Jun. 3, 1997 entitled "Method and Compositions for Decorating Glass", which application is assigned to the same assignee of the present application. The disclosures in the aforementioned applications are incorporated herein by reference.

Figure 4:
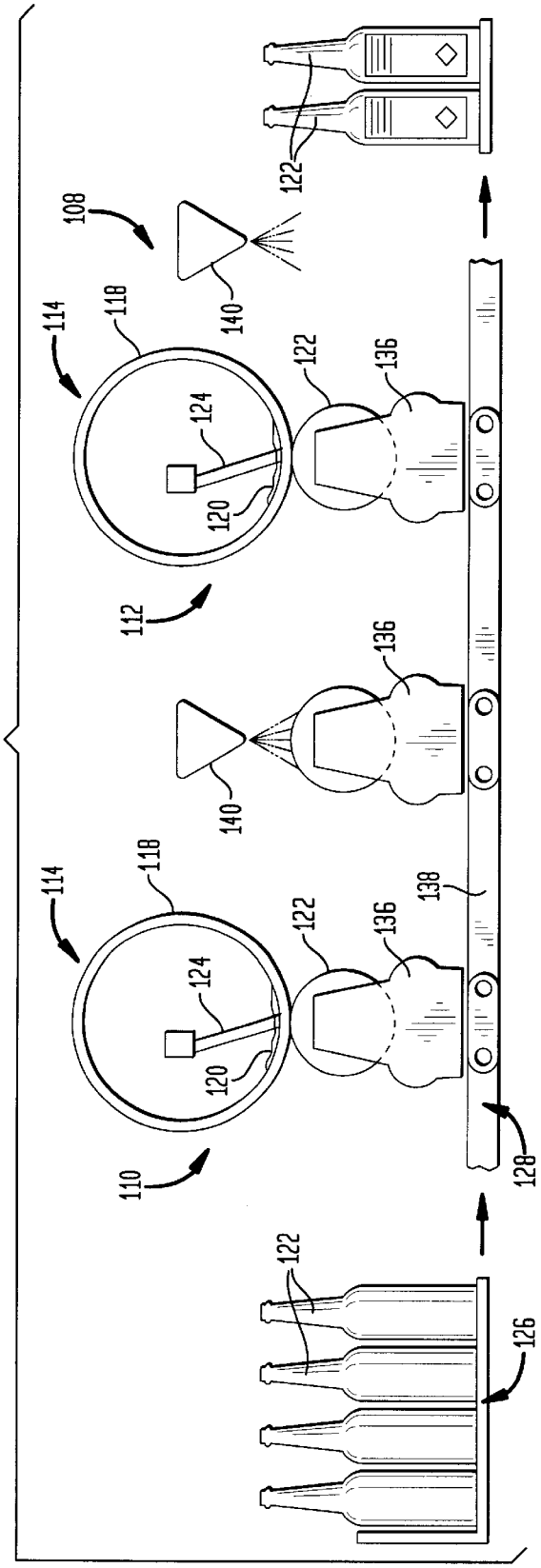
FIG. 4 is a diagrammatic illustration of an apparatus for screen printing UV curable pigmented compositions onto the surface of a cylindrical article in the nature of a beverage bottle by direct rotary screen printing in accordance with one embodiment of the present invention, including a device for emitting UV radiation at locations between a plurality of screen printing workstations.

Referring to FIG. 4, the screen printing apparatus 108 includes a plurality of sequential screen printing workstations 110, 112. Although only two workstations 110, 112 have been illustrated, it is to be understood that any number may be provided within the apparatus 108. At each screen printing workstation 110, 112, there is provided a screen printing assembly 114 in the nature of a continuous rotary screen printing device. Generally, each of the rotary screen printing assemblies 114 include a continuous cylindrical printing screen 118 through which a UV radiation curable composition 120 is applied in the desired pattern to an underlying article 122 by means of a squeegee device 124. The articles 122 to be decorated, which in the disclosed embodiment are beverage bottles, are transported through the apparatus 108 from a supply 126 thereof into registration with each of the screen printing assemblies 114 by means of a conveyor system 128. Each of the screen printing assemblies 114 is adapted to print an inked image of a color or texture, the same or different than the images to be printed by the remaining screen printing assemblies 114. The inked images may be registered to provide different resulting patterns, for example, partially or fully overlapping one another when decorating an article, as well as text material. Suitable screen printing assemblies 114 of the type as thus far described are available from Stork Screens America, Inc. of Charlotte, N.C. and Ferd. Ruesch AG of Switzerland.

The aforementioned screen printing assemblies 114 may be constructed in a variety of configurations. In each case, the screen printing assembly 114 will include a printing screen 118 and a squeegee device 124. The image to be printed is first engraved or otherwise provided on the printing screen 118. By way of one example, the printing screen 118 may be initially coated with a light sensitive lacquer. After exposing a film of the required image onto the lacquered printing screen 118, the light sensitive lacquer is washed away and the printing screen is ready for use. The squeegee device 124 is operative for internally pressing the UV radiation curable composition 120 through the perforated printing screen 118 onto the surface of the articles 122 to be decorated. Ink deposits can be varied by varying the pressure applied by the squeegee device 124.

It is contemplated that one or more of the same or different images may be formed in the printing screen 118 for transfer to the surface of an article 122 during operation of the screen printing assembly 114. Briefly in this regard, the screen printing assembly 114 is arranged with its axis of rotation in a horizontal orientation. In operation, the screen printing assembly 114 may be rotated either intermittently, or preferably continuously, during the screen printing process. By continuous rotation, it is contemplated that the maximum production rate for the screen printing apparatus 108 can be achieved. During rotation of the screen printing assembly 114, the squeegee device 124 may be held stationary, rotated in the opposite direction, or rotated in the same direction at a different speed. The rotary screen printing assembly 114 can be provided in a variety of diameters, for example, 10 inch, 16 inch and 20 inch diameters. Smaller and greater diameter rotary screen printing assemblies 114 are also contemplated within the scope of the present invention.

Figure 5:
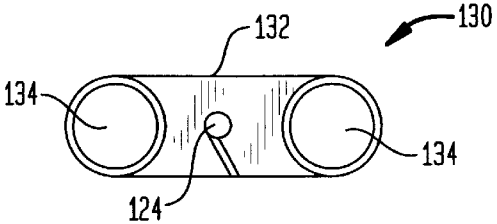
FIG. 5 is a diagrammatic illustration of a rotary screen printing assembly in the nature of a continuous rotating screen printing belt.

Turning to FIG. 5, there is shown another embodiment of a rotary screen printing assembly 130 including a similar squeegee device 124. The screen printing assembly 130 includes a continuous soft or flexible belt type printing screen 132 rotationally supported about a pair of spaced apart journals 134. The printing screen 132 may be rotated continuously or intermittently. This construction of the rotary screen printing assembly 130 includes a printing screen 132 of generally greater length than the printing screen 118 of the rotary screen printing assembly 114. This enables the provision of a greater number of images to be screen printed within a single screen printing workstation 110, 112. One such screen printing assembly 130 is available from Otto Isenschmid Corp. of Plainview, N.Y. Thus, it is to be appreciated that the rotary screen printing assembly 116, 130 may either be cylindrical as shown in FIG. 4, or oval as shown in FIG. 5.

The aforementioned rotary screen printing assemblies 114, 130 differ from the reciprocating shuttle-type screen printing assemblies in that the printing screens 118, 132 rotate about a rotational axis, as opposed to shuttling back and forth in a horizontal plane. This enables the rotary screen printing assemblies 114, 130 to occupy a smaller space within the apparatus 108, as well as to provide increased production rates as to be described hereinafter.

The conveyor system 128 is operative for transporting the articles 122 from the supply 126 through the screen printing apparatus 108 by either indexing or continuous motion as preferred for high production rates. As the articles 122 are supplied in a vertical orientation, they are initially reoriented into a horizontal orientation for conveying through the apparatus 108. This may be accomplished by any suitable known turning device which may include spaced apart elongated rails, such as those available from Werner Kammann of Germany and Carl Strutz & Co., Inc. of Mars, Pa., see also Von Saspe, U.S. Pat. No. 3,933,091. The articles 122 are similarly reoriented into a vertical orientation after the screen printing operation for further processing as may be desired.

A number of conveyor systems 128 of various construction are suitable for use in the screen printing apparatus 108 in accordance with the present invention which are well known in the prior art. For example, suitable conveyor systems 128 of the type as thus far described are available from Werner Kammann and Carl Strutz & Co., Inc. By way of one example, the conveyor system 128 is provided with a plurality of fixtures 136 adapted for releasably securing the articles 122 in either a horizontal or vertical orientation with respect to their longitudinal axis. The fixtures 136 are suitably connected to, by way of example, a continuous chain conveyor 138 which may form a continuous closed path through the screen printing apparatus 108. It is, however, to be understood that other conveyor systems 128 for transporting articles 122 through the screen printing apparatus 108 may be employed which are constructed differently from that described with respect to the conveyor system 128. For example, other conveyor systems are disclosed in Strutz, et al., U.S. Pat. Nos. 5,524,535; Walker, 4,091,726; Eldred, et al., 4,263,846; Heidenreich, 5,317,967; and Combeau, 4,434,714 the disclosures of which are incorporated herein by reference.

It can be appreciated that it is important to ensure that the inked image printed by one of the screen printing assemblies 114 is at least partially dried or cured before a second colored inked image is printed over the first image. Otherwise, interaction between the two differently colored inks may cause the colors to run or bleed, and the sharpness of the outline or contour of the composite image will be diminished. Furthermore, a portion of the ink which remains wet on the article 122 may adhere to the printing screen 118 of the next adjacent, downstream screen printing assembly 114, thereby causing further interaction of the inks, as well as other related problems.

In accordance with one embodiment of the present invention, the freshly applied outer surface of the inked image is at least partially cured by means of a UV radiation emitting source such as a UV lamp 140 located at or between each of the screen printing workstations 110, 112. Each of the UV lamps 140 is preferably positioned in the space between the screen printing workstations 110, 112 and above the fixtures 136 as shown in FIG. 4. As each article 122 is conveyed away from the printing screen 118, the inked image is exposed to the UV radiation emitted from the adjacent UV lamp 140 for a sufficient duration to at least partially cure the outer surface of the applied inked image. In this manner, the applied inked image may be at least partially cured prior to the articles 122 being advanced to the next screen printing workstation 110, 112. As previously noted, the radiation source may be other than UV radiation, for example, actinic radiation, electron beam, microwave radiation and/or infrared radiation supplied from a suitable source thereof.

As previously described, it is normally important to ensure that the inked image printed by one of the rotary screen printing assemblies 114 is at least partially cured before a second image is printed over the first image. It is therefore not required that the inked image be completely cured at each screen printing workstation 110, 112. As long as the applied inked image is at least partially cured, the inked image will not run or bleed and the sharpness of the outline or contour of the composite image will be preserved during subsequent screen printing of the next image at an adjacent screen printing workstation 110, 112. The curing of the applied inked image may be enhanced by raising the surface temperature of the articles 122 prior to the screen printing process. In this regard, an infrared lamp may be positioned at each screen printing workstation 110, 112 in advance of each rotary screen printing assembly 114. The infrared lamp will raise the surface temperature of the articles 122 in the range of about 300–350° F.

The cure rate of UV ink or coatings are dependent on the monomers, the concentration of the different monomers in the formula, initiation systems and the concentration of initiators, as well as the light intensity and wavelength. The necessary UV dose (energy) for curing a given UV curable coating or ink formula is constant in certain conditions. The full cure of a coating film is defined by the reacting of all active groups (acrylate double bonds, vinyl ether double bonds or epoxy functional groups) in the formula. A half or partial cure of the UV coating is defined by formation of a solid film with tack free surface in which the active functional groups are not completely reacted. The UV dose for a half cured coating film can be detected by a UV radiometer, e.g. the measurement of the same amount of energy used for obtaining tack free surface coating. The unit of half cure UV dose is energy irradiated on unit area (for example $mj/cm^2$). The half cure UV dose for different formulas can range from, as low as, 40 $mj/cm^2$ for acrylates system to 1,000 $mj/cm^2$ or more for epoxy, cationic photo initiation system. The preferred radiation curable compositions of the present invention include cationic UV curing inks as described in the aforementioned Kamen, et al. Patents.

Figure 6:
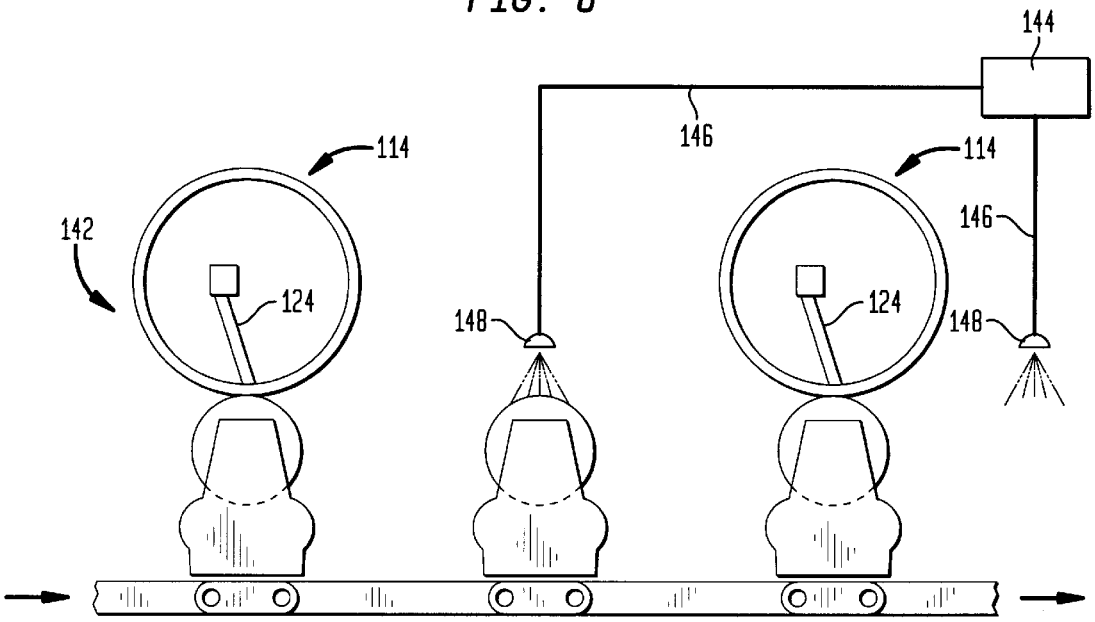
FIG. 6 is a diagrammatic illustration of an alternative arrangement of a device for emitting UV radiation at locations between a plurality of screen printing workstations.

Referring now to FIG. 6, there will be described a screen printing apparatus 142 constructed in accordance with another embodiment of the present invention. The apparatus 142 is similarly constructed with respect to the apparatus 108 as shown in FIG. 3. However, a UV source 144 is located at a remote location outside the apparatus 142. The UV source 144, for example, may comprise a laser radiation device emitting the appropriate wavelength for curing the applied inked image. The emitted laser radiation may be conducted to each of the screen printing assemblies 114 by means of a fiber optic bundle 146, a light pipe available from Fusion Technologies, Inc. or the like. The fiber optic bundle 146 terminates at location 148 overlying the decorated articles 122. The fiber optic bundle 146 may be divided so as to transmit the UV radiation to each of its designated locations 148, for example, between each of the screen printing workstations 110, 112. The apparatus 142 has been described using a single laser to transmit UV radiation to each of the screen printing assemblies 114. In addition, a plurality of individual lasers, one for each screen printing workstation 110, 112 may be provided in accordance with the present invention.

Figure 7:
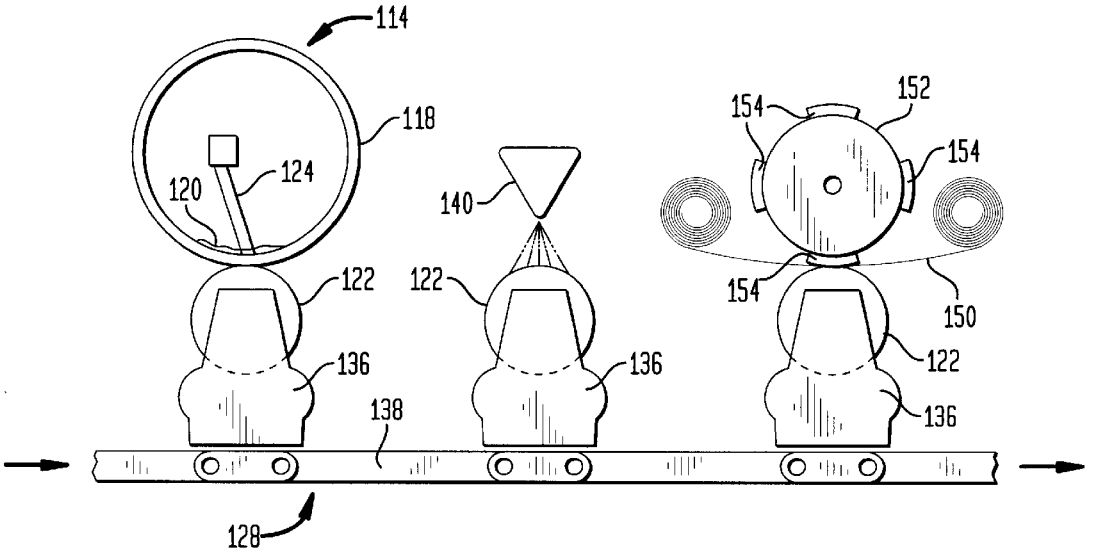
FIG. 7 is a diagrammatic illustration of an apparatus for screen printing UV curable pigmented compositions onto the surface of a cylindrical article in the nature of a beverage bottle by direct rotary screen printing, and further including a hot stamping workstation.

In another embodiment of the present invention as shown in FIG. 7, it is possible to provide a decorated article 122 which has a two-tone effect where a portion of the colored inked image on the article is hot stamped. For example, an article 122 such a beverage bottle may be decorated in a predetermined design by screening the radiation curable composition on the article and fully curing with electron beam or the appropriate radiation, e.g., UV radiation. It is also contemplated that a colorless ink may be used where the decoration is provided by a hot stamping foil 150. In either case, a layer of hot stamping foil 150 is then compressed against the article 122 with a rotary press 152 having platens 154 which are heated to a temperature sufficient to cause the hot stamping foil to adhere to the printed inked image but not to the inked free areas of the bottle.

Hot stamping foil 150 is generally a laminate including a carrier material (often polyester or a similar material capable of release), a release film between the carrier and a subsequent decorative coat which is usually a color or a metallized coat, most often aluminum or colored aluminum. The foil 150 may contain other optional layers such as one or more protective layers, hot melt adhesive layers, etc. between the metallized layer or layers and the carrier material. More specifically, hot stamping foil 150 can be defined as a multilayer web comprised of a backing film carrier, a release coating, one or more protective top coatings, one or more color coatings, and a hot melt adhesive, in that order.

The hot stamping foil 150 is then applied to the article with the hot melt adhesive layer being compressed against the article. The press 152, which may be a standard hot stamping rotary press, is heated to a temperature sufficient to cause the hot melt adhesive layer of the hot stamping foil 150 to adhere to the inked decorated portion of the article 122. Generally this temperature range is about 250–400° F. Temperatures higher than this will cause deterioration of the hot stamping foil 150 or some decomposition of the ink. The application of heat causes the adhesive side of the hot stamping foil 150 to become adhesively adhered to the inked design but not to the inked free areas of the article 122.

When the platens 154 are removed, a portion of the foil laminate adheres to the inked decoration but not to the ink-free areas of the glass. In particular, adhered to the colored inked design on the article is the hot melt adhesive layer, the color coatings, and the protective top coatings, in that order, of the hot stamping foil 150. Portions of the release coating may or may not be adhered to the protective top coating because the release coating is designed to melt upon application of heat and cause the polyester carrier backing layer to release from the protective top coat layer and some remnants may remain. The colored inked design on the article 122 can be fully or partially hot stamped as desired to yield a pleasant two tone metallic/color design.

Figure 8:
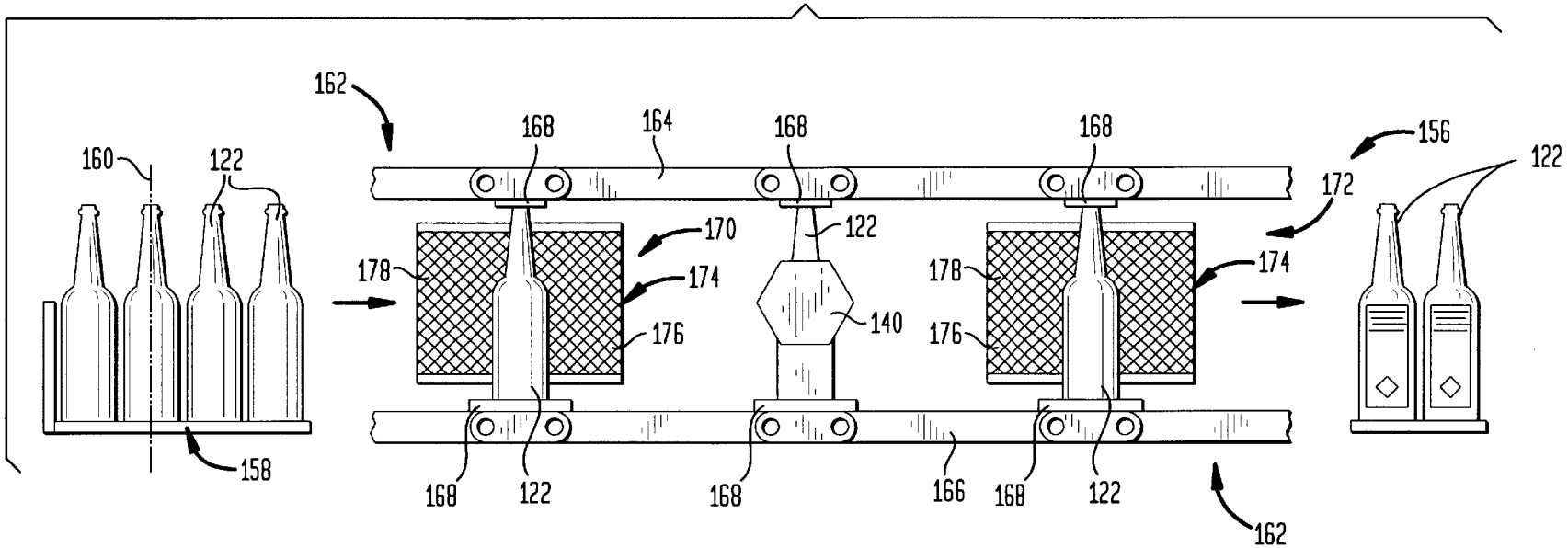
FIG. 8 is a diagrammatic illustration of an apparatus for screen printing UV curable pigmented compositions onto the surface of a cylindrical article in the nature of a beverage bottle by direct rotary screen printing in accordance with another embodiment of the present invention.

Referring to FIG. 8, there is disclosed a screen printing apparatus 156 constructed in accordance with another embodiment of the present invention. In accordance with apparatus 156, articles 122 to be decorated are transported through the apparatus in a vertical orientation as opposed to the horizontal orientation disclosed pursuant to apparatus 108. The articles 122 are fed from a supply 158 in the vertical orientation with respect to their longitudinal axis 160. By screen printing the articles 122 in a vertical orientation, it is not required to first reorient the articles in a horizontal printing orientation from their normal vertical supply orientation, and then to reorient the articles into a vertical discharge orientation after the screen printing operation. By eliminating the reorientation steps for the articles 122, the production rate of the screen printing apparatus 156 is increased.

To this end, the apparatus 156 includes a conveyor system generally designated by element 162. The conveyor system 162 includes an upper and lower chain conveyor 164, 166. The chain conveyors 164, 166 are provided with fixtures 168 for releasably engaging the respective upper and lower ends of the articles 122 as they are transported by the conveyor system 162. The conveyor system 162 as illustrated and described is by way of one example only for transporting the articles 122. In this regard, there are known a variety of arrangements for a conveyor system suitable for transporting articles 122 in a vertical orientation. By way of example, conveyor systems 162 are known from Dubuit, U.S. Pat. No. 4,176,598 the disclosure of which is incorporated herein by reference. Commercially available conveyor systems are obtainable from Krones, Inc. of Franklin, Wis. and Avery-Dennison, Equipment Division, USA.

The articles 122 to be described are conveyed through a plurality of workstations 170, 172 where there is provided a screen printing assembly 174 in the nature of a rotary screen printing device having a continuous circumferential printing screen 178. The rotary screen printing assembly 174 is oriented for rotation about a vertical axis whereby the printing screen 178 is arranged in a vertical plane. Due to the cylindrical nature of the rotary screen printing assembly 174 as in the case of screen printing assembly 114, and the articles 122 to be decorated, their respective surfaces are arranged tangentially to each other during the screen printing operation. This enables the high speed printing of accurate images onto the cylindrical surface of the articles 122.

As in the screen printing apparatus 108, there is provided a plurality of UV lamps 140 for at least partially curing the UV radiation curable material which has been screen printed onto the articles 122. Similarly, a rotary hot stamping press 152 may be incorporated at the end of the line for the screen printing apparatus 156 as previously described with respect to apparatus 108. In this regard, the decorating of articles 122 as previously described with respect to the screen printing apparatus 108, is the same screen printing process to be utilized and performed by the screen printing apparatus 156. The difference being in the orientation of the articles 122 within the apparatus 156 and that of the rotary screen printing assemblies 174 being arranged vertically, as opposed to horizontally.

Figure 9:
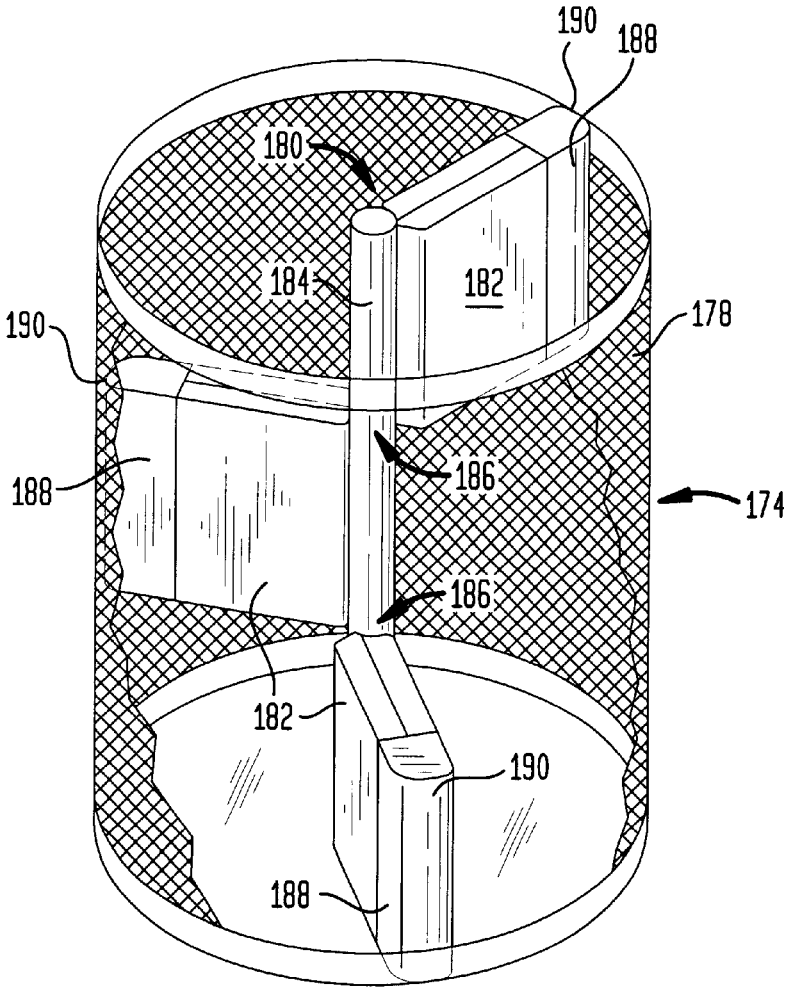
FIG. 9 is a diagrammatic illustration of a vertical screen printing assembly including a squeegee assembly constructed from a plurality of squeegee members.

Referring now to FIG. 9, one embodiment of a vertical rotary screen printing assembly 174 is illustrated in greater detail. A squeegee assembly 180 is positioned within the interior of the printing screen 178. The squeegee assembly 180 includes a plurality of vertically spaced apart rectangular shaped squeegee members 182. Any number of squeegee members 182 may be provided arranged about a center support 184 at various radial locations. In this regard, the squeegee members 182 may be equally spaced or at different radial spacings about the support 184. As shown, three squeegee members 182 are arranged about 120° apart. Preferably, the vertical height of each of the squeegee members 182 is such that they overlap one another at areas generally designated by reference numeral 186 in order to provide a continuous vertical inked area on the printing screen 178.

Each of the squeegee members 182 may be of conventional construction of suitable flexible or resilient polymer material and/or composites. For example, the leading portion 188 may be constructed of such polymer material, while the remainder of the squeegee member 182 may be constructed of a more rigid material, for example, metal, hard plastic, etc. The forward edge 190 of the squeegee members 182 generally has a radius of curvature corresponding to the radius of curvature of the printing screen 178 so as to ensure intimate contact therewith during the printing operation.

In use, a source of printing ink is supplied to the interior of the rotary screen printing device 176 as is well known in the screen printing industry. The printing ink is spread about the interior surface of the printing screen 178 by means of the squeegee members 182. In this regard, the printing screen 178 is typically rotated about its axis, either continuously or intermittently, while the squeegee assembly 180 remains stationary. However, it is contemplated that the squeegee assembly 180 can be rotated in the opposite direction to the printing screen 178, or in the same direction at a different speed. The supplied printing ink is thus squeezed through the patterned openings within the printing screen 178 to be deposited onto the passing bottles to be decorated.

Figure 10:
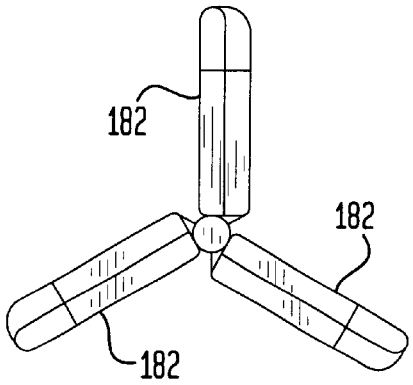
FIG. 10 is a top plan view of the squeegee assembly showing one arrangement of the squeegee members in accordance with another embodiment of the present invention.

As shown in FIG. 9, the squeegee members 182 are arranged in a vertical plane. To facilitate the spreading of the printing ink over the interior surface of the printing screen 178 in a vertical direction, the squeegee members may be arranged in an inclined plane as illustrated in FIG. 10. This results in the squeegee members 182 assuming a helical arrangement. The incline of the squeegee members 182 will have the effect of forcing the printing ink along a vertical direction to ensure coverage over the entire interior surface of the printing screen 178.

Figure 11:
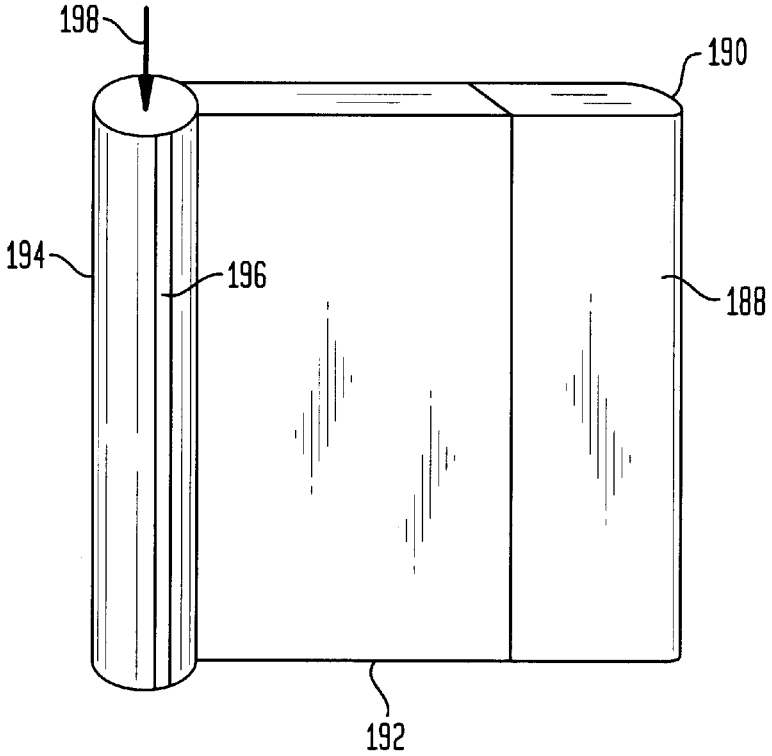
FIG. 11 is a diagrammatic illustration of a squeegee assembly constructed in accordance with another embodiment of the present invention.

Although only three squeegee members 182 have been illustrated, it is to be understood that any number of squeegee members may be employed. For example, it is contemplated that a single squeegee member 192 may be used as shown in FIG. 11. The squeegee member 192 is of similar construction spanning the length of the printing screen 178. In this regard, the squeegee member 192 may be arranged in a vertical orientation or at an incline. The squeegee member 192 may be arranged adjacent a hollow printing ink supply tube 194 having an elongated slot 196 arranged longitudinally. Printing ink is supplied to the interior of the supply tube 194 from a source thereof as generally indicated by the arrow 198. The supply tube 194 is rotated about its longitudinal axis, by way of example only, simultaneously with rotation of the printing screen 178. This results in the generated centrifugal force causing the printing ink to flow outwardly through the slot 196 onto the adjacent surface of the squeegee member 190. The printing ink continues its outward radial flow to the leading portion 188 of the squeegee member 192 where it is deposited uniformly over the interior surface of the printing screen 174. Excess printing ink within the rotary screen printing device 176 may be recycled using any suitable means, for example, a pump and the like.

Figure 12:
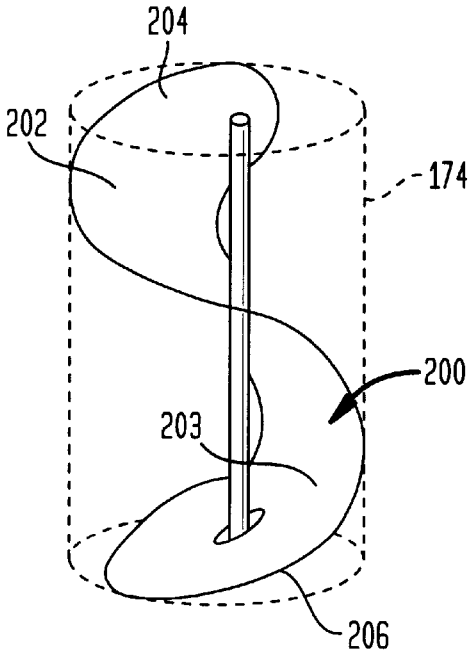
FIG. 12 is a diagrammatic illustration of a squeegee assembly in the nature of a helical member constructed in accordance with another embodiment of the present invention.

In the preferred embodiment as shown in FIG. 12, the squeegee member 200 is constructed in the nature of a helical member 202 having a planar surface 203 forming any number of desired turns. The helical member 202 may be constructed of unitary or composite material as previously described with respect to squeegee members 182, 192. In this regard, the outer peripheral portion 204 of the squeegee member 202 can be constructed from polymer material having a curved leading edge portion 206. Printing ink is supplied into the interior of the screen printing assembly 174 where it is applied to the interior of the printing screen 178 by means of the helical member 202. In this regard, the helical member, functioning as a screw, will via its leading portion 206 force the printing ink through the patterned portion of the printing screen 178 during rotation of the printing screen. The helical member 202 may be stationary while the printing screen 178 is rotated, or the helical member may be rotated in a direction opposite to that of the printing screen, or the helical member may be rotated at a different rotational speed from the printing screen as previously described. The use of a helical member 202 is preferred in the sense that it is contemplated that the screw like nature of the helical member will provide a more efficient and uniform application of the printing ink to the interior surface of the printing screen 178.

As previously described, in order to achieve high production rates, it is preferred that the articles 122 be transported through the screen printing apparatus 108, 156 in a high speed continuous uninterrupted motion while the printing screen 178 is also continuously rotated. In other words, the articles 122 to be screen printed are brought into contact with the screen printing assembly 114, 174 as the articles are transported therepast in a continuous motion. This is distinguished from indexing where the articles 122 are momentarily stopped during the screen printing operation. In the case of continuous motion, it is contemplated that there is the possibility of smudging of the screen printed inked pattern resulting from the forward or continuous motion of the articles 122 as they are brought into contact with the screen printing assembly 114, 174, which although rotating, is held at a stationary position. This can therefore occur even though the articles 122 and screen printing assembly 114, 174 are rotated to provide relative nil speed therebetween during the printing process. It is therefore desirable to provide zero relative forward and rotational motion between the articles 122 and screen printing assembly 114, 174 during the screen printing operation so as to prevent smudging and to ensure the greatest definition and detail of the pattern to be screen printed.

Figure 13:
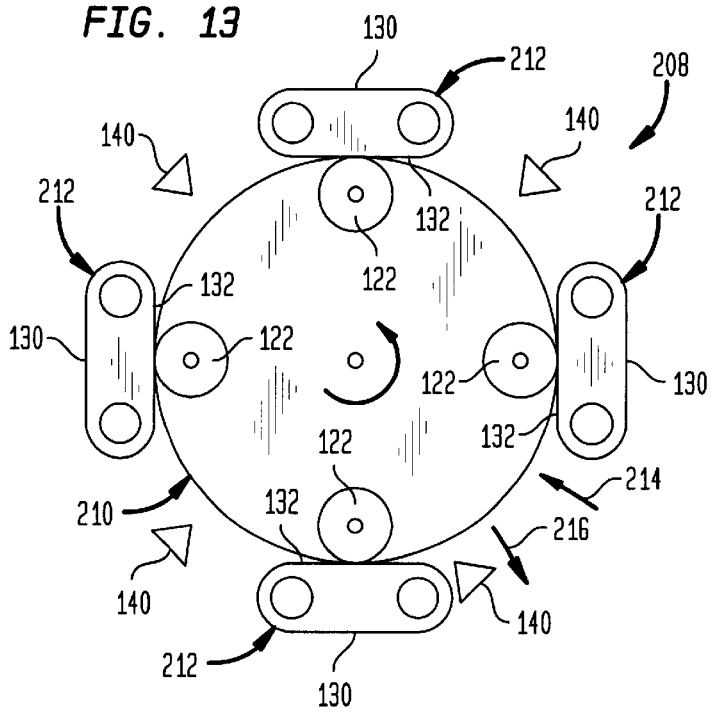
FIG. 13 is a diagrammatic illustration of a turntable arrangement for transporting beverage bottles past a plurality of screen printing assemblies in accordance with another embodiment of the present invention.

To this end, there is shown in FIG. 13 a diagrammatic illustration of a four color screen printing apparatus generally designated by reference numeral 208. The screen printing apparatus 208 is provided with a turntable 210 of conventional design adapted to transport articles 122 past a plurality of screen printing stations 212 in a continuous uninterrupted motion. One suitable turntable 210 is available from Krones, Inc. Articles 122 to be screen printed are supplied to the turntable 210 in a conventional manner, for example, at location 214 in a vertical orientation. The articles 122 are transported in a circular path via the turntable 210 past the plurality of screen printing stations 212 where, for example, a separate color of printing ink can be screen printed onto each of the articles. In addition, a hot stamping operation can also be performed if desired. In any event, the articles 122 while being transported by the turntable 210 are rotated in either a clockwise or counterclockwise direction as they pass each of the screen printing stations 212.

At each of the screen printing stations 212, there is provided a rotary screen printing assembly 130 of the type described with respect to FIG. 5 which includes a continuous soft or flexible belt-type printing screen 132. Although the printing screen 132 may be rotated in either a clockwise or counterclockwise direction, it is preferred that the printing screen be rotated in a direction opposite to that of the rotation of the article 122 during the screen printing operation. In this regard, the relative rotational speed between the article 1.22 and printing screen 132 at their point of contact, i.e., tangent line, is zero. However, due to the forward motion of the article 122 via its transport by the turntable 210, there is provided a certain degree of relative forward motion which might cause smudging to the inked pattern. This smudging can be eliminated by extending the tangent line of zero relative speed between the articles 122 and printing screen 132 from a line contact to an area contact by the use of the rotary screen printing device 130. In this regard, the soft or flexible belt-type printing screen 132 provides a screen printing area of greater width than line contact resulting from the use of a cylindrical screen printing apparatus 108, 156 as shown in FIGS. 4 and 8. The cumulative effect is that there is a longer dwell time of zero relative motion between the article 122 and the printing screen 132 to compensate for the forward motion of the article as it is being continuously conveyed by the turntable 210. The screen printed articles 122 are discharged from the turntable 210 via outlet location 216.

Figure 14:
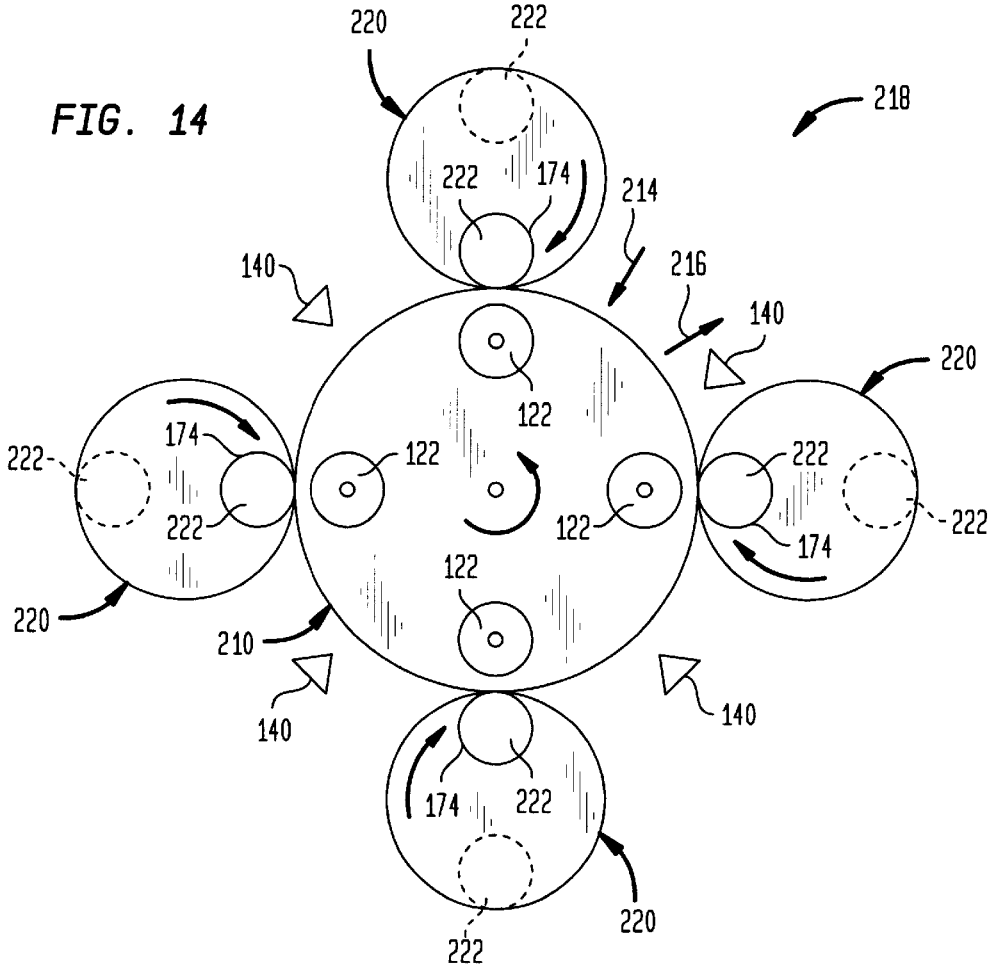
FIG. 14 is a diagrammatic illustration of a multiple turntable arrangement for transporting beverage bottles past a plurality of screen printing assemblies in accordance with still another embodiment of the present invention.

In accordance with another embodiment of the present invention, there is illustrated in FIG. 14 a four color screen printing apparatus 218 which includes a similar turntable 210. Arranged circumferentially about turntable 210 are a plurality of second turntables 220 which each support at least one screen printing station 222 each including a vertical screen printing assembly 174 of the type described with respect to FIG. 8 and FIGS. 9–12. Each of the screen printing stations 222 are operative for screen printing a particular color of printing ink onto the peripheral surface of the articles 122 in the manner as previously described. Optionally, more than one screen printing station 222 can be provided at each of the turntables 220 for increasing the screen printing rate.

In operation, the turntable 210 is rotated in the opposite direction as the rotation of turntables 220, either clockwise or counterclockwise. In addition, the circumferential speed of rotation of the turntables 210, 220 are synchronized to be approximately the same, or preferably, turntables 220 moving slightly faster than turntable 210. By moving the screen printing stations 222 at substantially the same speed as the movement of the articles 122 along their tangent line by means of turntable 210, there is no forward motion component of the articles relative to the screen printing assemblies 174 along the tangent line during the very short duration of the screen printing operation, e.g., 69–86 milliseconds for production rates of 400–500 articles per minute. Accordingly, by rotating the articles 122 and the screen printing assembly 174 in opposite directions, as previously described, there is zero relative motion along the tangent line or point of contact therebetween during the entire screen printing operation. It is therefore possible to design the screen printing assembly 174 to have a diameter the same diameter as the articles 122, if so desired, as the screen printing assembly can be rotated 360° during each printing operation on the articles. Accordingly, by moving the screen printing assemblies 174 at the same approximate speed as the circumferential motion of the articles 122, higher resolutions and screen printed details can be achieved in accordance with the present invention.

In the preferred arrangement, the screen printing assemblies 130, 174 are indexed perpendicular to the articles 122 so as to make contact therewith only as the articles pass the screen printing assembly for screen printing. This indexing may be achieved in any number of known manners, for example, using a cam mechanism. In this regard, the screen printing assemblies 130, 174 are initially positioned slightly away from the surface of the incoming article 122. As the article 122 approaches the area opposing the screen printing assemblies 130, 174, the cam mechanism will move the screen printing assembly into contact with the passing article 122 for sufficient time to screen print the surface of the article. Once the article 122 passes the screen printing assemblies 130, 174, the screen printing assembly will be indexed away from the screen printing area until the next article is brought thereto by rotation of the turntable 210. The freshly applied outer surface of the inked image is at least partially cured by means of a UV radiation emitting source, such as a UV lamp, located at or between each of the screen printing stations 212, 222 as previously described. In this manner, the applied image may be at least partially cured prior to the articles 122 being advanced to the next screen printing assembly.

As thus far described, articles 122 having a generally cylindrical configuration may be screen printed at rates in excess of 250 bottles per minute, and at rates in a range of 500–700 bottles a minute, and optimally up to 1000 bottles per minute. It is, however, to be understood that lower production rates are also contemplated in accordance with the present invention, i.e., rates less than about 250 bottles per minute. This is accomplished by means of the use of the rotary screen printing assemblies 114, 174 in combination with UV radiation curable compositions. The higher production rates are particularly achieved by orienting the screen printing assembly 174 in a vertical orientation as shown in FIG. 8. In this regard, articles 122 to be screen printed do not have to be reoriented from their vertical orientation to a horizontal orientation for screen printing.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. Apparatus for direct rotary printing a layer of radiation curable material onto individual articles having a cylindrical surface, said apparatus comprising a supply of radiation curable material, a stationary rotary printing assembly operative for directly printing a layer of said radiation curable material onto the cylindrical surface of said individual articles, said rotary printing assembly comprising a rotationally supported belt having a planar portion for contact with said cylindrical surface of said articles for directly printing said layer of said radiation curable material thereon, a radiation emitting device adjacent said rotary printing assembly operative for at least partially curing said layer of radiation curable material applied to said articles, means for transporting said articles into operative relationship with said rotary printing assembly and said radiation emitting device, and a plurality of fixtures for releasably securing said articles to said transporting means, said fixtures operative for rotating said articles when at least in operative association with said planar portion of said rotary printing assembly.

2. The apparatus of claim 1, wherein said rotary printing assembly comprises a screen printing assembly.

3. The apparatus of claim 2, wherein said means comprises a conveyor for continuously transporting said articles into operative relationship with said rotary screen printing assembly and said radiation emitting device.

4. The apparatus of claim 2, wherein said articles are transported at a rate greater than about 250 articles per minute.

5. The apparatus of claim 1, wherein said rotary printing assembly is arranged for rotation about a horizontal axis.

6. The apparatus of claim 1, wherein said rotary screen printing assembly is arranged for rotation about a vertical axis.

7. The apparatus of claim 1, wherein said radiation emitting device comprises a UV radiation emitting device.

8. The apparatus of claim 1, wherein said rotary printing assembly is continuously rotated during the operation of said apparatus.

9. The apparatus of claim 1, further including a rotary hot stamping assembly, said rotary hot stamping assembly operative for applying a layer of film material onto the cylindrical surface of said articles.

10. The apparatus of claim 1, wherein said rotary printing assembly belt comprises a continuous belt rotationally supported about at least a pair of spaced apart journals.

11. The apparatus of claim 1, wherein said radiation emitting device is fixedly mounted adjacent said rotary printing assembly.

12. The apparatus of claim 1, wherein the transporting means is operative for continuously moving said articles past said rotary printing assembly while said articles are being printed with said layer of said radiation curable material.

13. The apparatus of claim 2, wherein said rotary screen printing assembly includes at least one squeegee rotatable during the rotation of said rotary screen printing assembly for printing said layer of said radiation curable material onto the cylindrical surface of said articles.

14. The apparatus of claim 13, wherein said squeegee is rotated in the same direction as the direction of rotation of said articles.

15. The apparatus of claim 2, wherein said rotary screen printing assembly including at least one squeegee rotatable during the rotation of said rotary screen printing assembly for printing said layer of said radiation curable material onto the cylindrical surface of said articles, and wherein said squeegee is rotated in the same direction as the direction of rotation of said articles and in the opposite direction as the direction of rotation of said rotary screen printing assembly.

16. The apparatus of claim 15, wherein said rotary screen printing assembly is rotated in the opposite direction as the direction of rotation of said articles.

17. The apparatus of claim 1, wherein said rotary printing assembly is rotated in the opposite direction as the direction of rotation of said articles.

18. Apparatus for direct rotary screen printing a patterned layer of UV radiation curable material onto glass bottles having a cylindrical surface and a longitudinal axis, said apparatus comprising a rotary screen printing assembly having an interior portion at least partially defined by a printing screen, said rotary screen printing assembly operative for direct screen printing said patterned layer of UV radiation curable material onto the cylindrical surface of said glass bottles, a supply of UV radiation curable material provided within said interior portion of said rotary screen printing assembly, a rotatable squeegee within said interior portion of said rotary screen printing assembly for dispersing said UV radiation curable material over at least a portion of said printing screen for screen printing said patterned layer, a UV radiation emitting device adjacent said rotary screen printing assembly operative for at least partially curing said patterned layer of UV radiation curable material applied to said bottles, and a conveyor extending through said apparatus for transporting said bottles into operative relationship within said rotary screen printing assembly and said UV radiation emitting device, said conveyor including a plurality of fixtures for releasably securing said bottles thereto and for rotating said bottles about said axis when in operative association with said rotary screen printing assembly, said squeegee rotatable in the same direction as the direction of rotation of said bottles during the direct screen printing of said patterned layer.

19. The apparatus of claim 18, wherein said conveyor is operative for transporting said bottles at a rate greater than about 250 bottles per minute.

20. The apparatus of claim 18, wherein said rotary screen printing assembly is arranged for rotation about a horizontal axis.

21. The apparatus of claim 18, wherein said rotary screen printing assembly is arranged for rotation about a vertical axis.

22. The apparatus of claim 18, further including at least one rotary hot stamping assembly, said rotary hot stamping assembly operative for applying a layer of a film material onto the cylindrical surface of said bottles.

23. The apparatus of claim 18, wherein said rotary screen printing assembly comprises a continuous belt rotationally supported about at least a pair of spaced apart journals.

24. The apparatus of claim 18, wherein said rotary screen printing assembly is rotated in the opposite direction as the direction of rotation of said bottles.

25. A process for directly applying a layer of radiation curable material onto articles having a cylindrical surface, said process comprising conveying said articles into operative association with a rotary screen printing assembly having at least one squeegee, rotating said articles when in operative association with said screen printing assembly, directly screen printing a layer of radiation curable material onto the cylindrical surface of said articles while said articles are being rotated using said rotary screen printing assembly, rotating said at least one squeegee in the same direction as rotation of said articles during said screen printing, and exposing the screen printed layer on said articles to radiation sufficient to at least partially cure the screen printed layer.

26. The process of claim 25, wherein said radiation curable material comprises UV curable material.

27. The process of claim 25, wherein said screen printing comprises rotating said rotary screen printing assembly about a horizontal axis.

28. The process of claim 25, wherein said screen printing comprises rotating said rotary screen printing assembly about a vertical axis.

29. The process of claim 28, further including supplying said radiation curable material to said rotary screen printing assembly, said rotary screen printing assembly including an interior portion at least partially defined by a printing screen for screen printing said layer of radiation curable material.

30. The process of claim 29, wherein said supplying comprises dispensing said radiation curable material over at least a portion of said printing screen.

31. The process of claim 25, wherein said conveying said articles comprise a rate greater than about 250 articles per min.

32. The process of claim 25, wherein said layer of radiation curable material comprises a predetermined patterned layer.

33. The process of claim 25, further including continuously conveying said articles into operative association with said rotary screen printing assembly, continuously rotating said rotary screen printing assembly for screen printing said radiation curable material onto the cylindrical surface of said articles, and continuously exposing said screen printed layer on said articles to said radiation.

34. The process of claim 25, further including rotary hot stamping a layer of a film material onto the cylindrical surface of said articles.

35. The process of claim 25, wherein said articles have a longitudinal axis, said articles conveyed to said rotary screen printing assembly in a vertical orientation with respect to said longitudinal axis.

36. The process of claim 25, wherein said rotary screen printing assembly comprises a continuous belt rotationally supported about at least a pair of spaced apart journals.

37. The process of claim 25, wherein said rotary screen printing assembly is rotated in the opposite direction to the direction of rotation of said articles.

38. The process of claim 25, wherein said squeegee is rotated in the opposite direction of rotation as said rotary screen printing assembly.

39. The process of claim 25, wherein said rotation of said rotary screen printing assembly and said articles provides relative zero surface speed therebetween during said screen printing.

40. A process for directly applying a patterned layer of UV radiation curable material onto glass bottles having a cylindrical surface, said process comprising screen printing said patterned layer of UV radiation curable material directly onto the cylindrical surface of said bottles using a rotary screen printing assembly, said rotary screen printing assembly having an interior portion at least partially defined by a printing screen and at least one squeegee rotatably arranged within said interior portion, rotating said bottles in operative association with said rotary screen printing assembly, supplying UV radiation curable material into the interior portion of said rotary screen printing assembly, dispensing said UV radiation curable material over at least a portion of said printing screen for screen printing said patterned layer of UV radiation curable material by rotating said at least one squeegee in the same direction as the direction of rotation of said bottles, exposing the screen printed layer on said bottles to radiation sufficient to at least partially cure the screen printed layer, and conveying said bottles into operative association with said rotary screen printing assembly and said radiation.

41. The process of claim 40, further including rotary hot stamping a layer of a film material onto the cylindrical surface of said bottles.

42. The process of claim 40, wherein said screen printing comprises rotating said rotary screen printing assembly about a horizontal axis.

43. The process of claim 40, wherein said screen printing comprises rotating said rotary screen printing assembly about a vertical axis.

44. The process of claim 40, wherein said conveying said bottles comprises a rate greater than about 250 bottles per minute.

45. The process of claim 40, further including continuously rotating said rotary screen printing assembly for continuously screen printing said UV radiation curable material onto the cylindrical surface of said bottles, continuously exposing the screen printed layer on said bottles to said radiation and continuously conveying said bottles onto operative association with said rotary screen printing assembly and said radiation.

46. The process of claim 40, further including conveying said bottles into operative association with a plurality of rotary screen printing assemblies for screen printing a plurality of patterned layers of UV radiation curable material onto the cylindrical surface of said bottles.

47. The process of claim 40, wherein said rotary screen printing assembly comprises a continuous belt rotationally supported about at least a pair of spaced apart journals.

48. The process of claim 40, wherein said rotary screen printing assembly is rotated in the opposite direction to the direction of rotation of said bottles.

49. The process of claim 40, wherein said squeegee is rotated in the opposite direction of rotation as said rotary screen printing assembly.

50. The process of claim 40, wherein said rotation of said rotary screen printing assembly and said bottles provides relative zero surface speed therebetween during said screen printing.

51. A process for directly applying a patterned layer of UV radiation curable material onto glass bottles having a cylindrical surface, said process comprising screen printing said patterned layer of UV radiation curable material directly onto the cylindrical surface of said bottles using a rotary screen printing assembly, said rotary screen printing assembly having an interior portion at least partially defined by a printing screen and at least one squeegee rotatably arranged within said interior portion, rotating said bottles when in operative association with said rotary screen printing assembly, supplying UV radiation curable material into the interior portion of said rotary screen printing assembly, dispensing said UV radiation curable material over at least a portion of said printing screen for screen printing said patterned layer of UV radiation curable material by rotating said at least one squeegee in the same direction as the direction of rotation of said bottles and in the opposite direction of rotation of said rotary screen printing assembly, exposing the screen printed layer on said bottles to radiation sufficient to at least partially cure the screen printed layer, and conveying said bottles into operative association with said rotary screen printing assembly and said radiation.

52. The process of claim 51, wherein said rotation of said rotary screen printing assembly and said bottles provides relative zero surface speed therebetween during said screen printing.

53. Apparatus for direct rotary screen printing a patterned layer of UV radiation curable material onto glass bottles having a cylindrical surface, said apparatus comprising a rotary screen printing assembly having an interior portion at least partially defined by a printing screen, said rotary screen printing assembly operative for direct screen printing said patterned layer of UV radiation curable material onto the cylindrical surface of said glass bottles, a supply of UV radiation curable material provided within said interior portion of said rotary screen printing assembly, a squeegee within said interior portion for dispersing said UV radiation curable material over at least a portion of said printing screen for screen printing said patterned layer, said squeegee rotatable in the same direction as the direction of rotation of said bottles and in the opposite direction to the direction of rotation of said screen printing assembly during said direct screen printing of said patterned layer, a UV radiation emitting device fixedly mounted adjacent said rotary screen printing assembly operative for at least partially curing said patterned layer of UV radiation curable material applied to said bottles, a conveyor extending through said apparatus for transporting said bottles into operative relationship within said rotary screen printing assembly and said UV radiation emitting device, wherein said conveyor includes a plurality of fixtures for releasably securing said bottles thereto, said fixtures operative for rotating said bottles when in operative association with said rotary screen printing assembly.

54. The apparatus of claim 53, wherein said rotation of said rotary screen printing assembly and said bottles provides relative zero surface speed therebetween during said screen printing.

55. A process for directly applying a layer of radiation curable material onto individual articles having a cylindrical surface, said process comprising conveying said articles into operative association with a stationary rotary printing assembly including a rotationally supported belt having a planar portion for contact with said cylindrical surface of said articles for directly printing said layer of radiation curable material thereon, rotating said articles when in operative contact with said planar portion of said belt, directly printing a layer of radiation curable material from said planar portion of said belt onto the cylindrical surface of said articles using said rotary printing assembly while said articles are being rotated, and exposing the printed layer on said articles to radiation sufficient to at least partially cure the printed layer.

* * * * *